US005419432A

United States Patent [19]

Ingram

[11] Patent Number: 5,419,432

[45] Date of Patent: May 30, 1995

[54] GARMENT BAG FOR DRESSER

[76] Inventor: Joyce L. Ingram, 5903 Spring Creek La., Atlanta, Ga. 30350

[21] Appl. No.: 298,617

[22] Filed: Aug. 31, 1994

[51] Int. Cl.[6] ..... B65D 85/18

[52] U.S. Cl. ..... 206/287; 206/280; 206/292

[58] Field of Search ..... 206/289, 287.1, 292, 206/293, 279, 280, 286, 287

[56] References Cited

U.S. PATENT DOCUMENTS

| | | | |
|---|---|---|---|
| 2,862,586 | 12/1958 | Davis | 206/287.1 |
| 3,258,181 | 6/1966 | Peters | 206/292 X |
| 3,944,032 | 3/1976 | Samhammer et al. | 206/292 |
| 4,662,513 | 5/1987 | King et al. | 206/287.1 |
| 4,693,368 | 9/1987 | King et al. | 206/287.1 |
| 4,727,987 | 3/1988 | Zezza | 206/292 X |
| 4,927,014 | 5/1990 | Pulichino, Jr. | 206/287.1 |
| 5,014,830 | 5/1991 | Seynhaeve | 206/293 X |
| 5,255,766 | 10/1993 | Deconinck | 206/292 X |
| 5,330,049 | 7/1994 | Bertelsen et al. | 206/287.1 X |

*Primary Examiner*—Allan N. Shoap
*Assistant Examiner*—Christopher J. McDonald

[57] ABSTRACT

A garment bag for dresses comprising a bag having a front wall, a back wall offset from the front wall, and a periphery formed of a top edge, a bottom edge, and opposed side edges interconnecting the front wall to the back wall to thereby define a hollow interior; a securable door mechanism formed on the bag for allowing access to the interior in one orientation and preventing such access in another orientation; a hanger mechanism coupled to the bag and extendable upwards above the top edge for allowing the bag to be hung from a recipient object; a hanger bar mechanism coupled to the bag at a location facing the interior for holding dress-laden clothes hangers; and an adjustable hem clasp mechanism coupled to the bag and facing the interior for gripping dresses therebetween extended downwards from dress-laden hangers held by the hanger bar mechanism.

8 Claims, 3 Drawing Sheets

FIG. 1
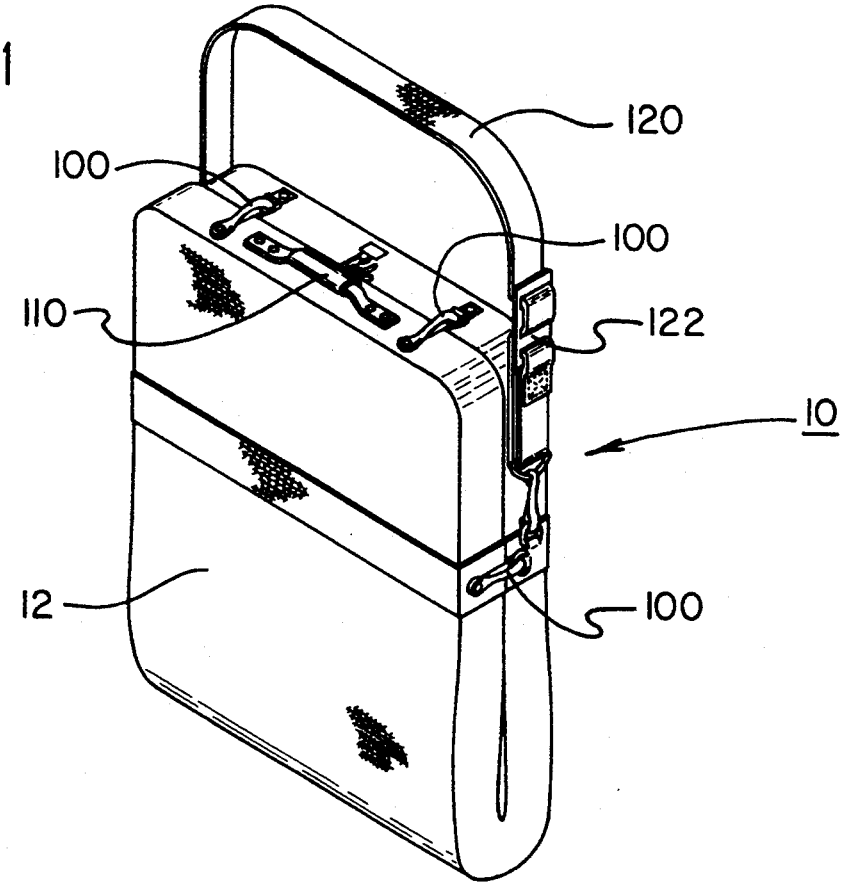
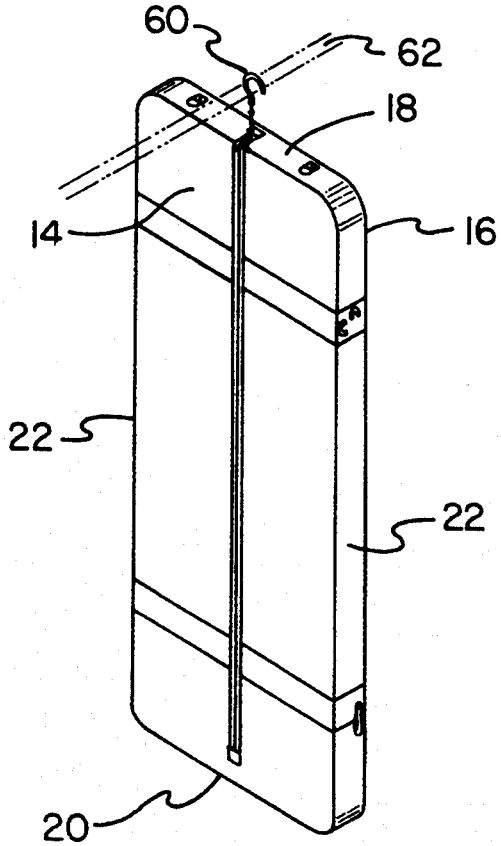
FIG. 2

GARMENT BAG FOR DRESSER

BACKGROUND OF THE INVENTION

1. Field of the Invention

The present invention relates to a garment bag for dresses and more particularly pertains to allowing a traveler to transport dresses of varying lengths from one location to another while preventing them from being wrinkled with a garment bag for dresses.

2. Description of the Prior Art

The use of garment bags is known in the prior art. More specifically, garment bags heretofore devised and utilized for the purpose of carrying clothes are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 281,651 to Bomes et al. discloses a garment bag. U.S. Pat. No. Des. 285,869 to Ronen discloses a garment bag. U.S. Pat. No. Des. 320,115 to King discloses a garment bag. U.S. Pat. No. 3,811,543 to Parrochia discloses a garment bag. U.S. Pat. No. 4,438,844 to Kesselman et al. discloses a traveling garment bag. U.S. Pat. No. 4,736,839 to King discloses a garment bag.

While these devices fulfill their respective, particular objective and requirements, the aforementioned patents do not describe a garment bag for dresses that holds dresses for transport from one location to another and prevents the dresses from being wrinkled in the transport process.

In this respect, the garment bag for dresses according to the present invention substantially departs from the conventional concepts and designs of the prior art, and in doing so provides an apparatus primarily developed for the purpose of allowing a traveler to transport dresses of varying lengths from one location to another while preventing them from being wrinkled.

Therefore, it can be appreciated that there exists a continuing need for new and improved garment bag for dresses which can be used for allowing a traveler to transport dresses of varying lengths from one location to another while preventing them from being wrinkled. In this regard, the present invention substantially fulfills this need.

SUMMARY OF THE INVENTION

In the view of the foregoing disadvantages inherent in the known types of garment bags now present in the prior art, the present invention provides an improved garment bag for dresses. As such, the general purpose of the present invention, which will be described subsequently in greater detail, is to provide a new and improved garment bag for dresses and method which has all the advantages of the prior art and none of the disadvantages.

To attain this, the present invention essentially comprises, in combination, a bag formed of a flexible fabric material and having a generally rectangular front wall, a generally rectangular back wall offset from the front wall, and a periphery formed of a top edge, a bottom edge, and opposed side edges interconnecting the front wall to the back wall to thereby define a hollow interior. An upper reinforcing strap and a lower reinforcing strap are included and formed of a fabric material with the upper reinforcing strap secured about the front wall, back wall, and side edges at a location offset below the top edge and the lower reinforcing strap secured about the front wall, rear wall, and side edges at a location offset above the bottom edge. An upper reinforcing insert and a lower reinforcing insert are included. Each reinforcing insert is formed of rigid plastic. Each reinforcing insert has a U-shape formed with a cross leg and two side legs. The upper reinforcing insert is coupled to the periphery of the bag at a location adjacent to the interior such that its cross leg is extended along the top edge and its side legs are extended downwards along the side edges. The lower reinforcing insert is coupled to the periphery of the bag at a location adjacent to the interior such that its cross leg is extended along the bottom edge and its side legs are extended upwards along the side edges. A zipper is extended downwards from the center of the top edge of the bag to a central location on the front wall near the bottom edge. The zipper has an opened orientation for allowing access to the interior and a closed orientation for preventing such access. A rigid metal hanger is included for allowing the bag to be hung from a recipient object with the hanger having a base coupled to the upper reinforcing insert at a location aligned with the zipper, a hook, and a chain therebetween. A rigid metal hanger bar is included and coupled to the upper reinforcing insert and extended towards the interior and with the hanger bar further having a plurality of slots formed therethrough adapted for holding dress-laden clothes hangers. A pair of opposed hem clasp mechanisms are included with each hem clasp mechanism coupled to a side leg of the lower reinforcing insert at a location adjacent to the interior. Each hem clasp mechanism is formed of four parallel ribs extended along each side leg with a hem clasp slidably and removably coupled to each rib. Opposed hem clasps of the opposed hem clasp mechanisms are adapted for gripping a dress therebetween extended downwards from a dress-laden hanger held by the hanger bar. Edge fastener means are included and coupled to the periphery of the bag remote from the interior. The edge fastener means are coupled in one orientation for placing the bag in a folded and generally U-shaped carrying configuration such that its bottom edge is positioned in proximity with its top edge and its zipper is concealed. The edge fastener means are decoupled in another orientation for allowing the bag to be placed in a hanging configuration such that its top edge is positioned above its bottom edge and its zipper is visible. A handle is included and coupled to the bottom edge of the bag for allowing the bag to be carried by a traveler by hand in the carrying configuration. Lastly, an adjustable shoulder strap is included and has its free ends secured to the upper reinforcing strap on opposed side edges of the bag for allowing the bag to be carried over a traveler's shoulder in the carrying configuration.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved garment bag for dresses which has all the advantages of the prior art garment bags and none of the disadvantages.

It is another object of the present invention to provide a new and improved garment bag for dresses which may be easily and efficiently manufactured and marketed.

It is a further object of the present invention to provide a new and improved garment bag for dresses which is of durable and reliable construction.

An even further object of the present invention is to provide a new and improved garment bag for dresses which is susceptible of a low cost of manufacture with regard to both materials and labor, and which accordingly is then susceptible of low prices of sale to the consuming public, thereby making such a garment bag for dresses economically available to the buying public.

Still yet another object of the present invention is to provide a new and improved garment bag for dresses which provides in the apparatuses and methods of the prior art some of the advantages thereof, while simultaneously overcoming some of the disadvantages normally associated therewith.

Even still another object of the present invention is to provide a new and improved garment bag for dresses for allowing a traveler to transport dresses of varying lengths from one location to another while preventing them from being wrinkled.

Lastly, it is an object of the present invention to provide a new and improved garment bag for dresses comprising a bag having a front wall, a back wall offset from the front wall, and a periphery further formed of a top edge, a bottom edge, and opposed side edges interconnecting the front wall to the back wall to thereby define a hollow interior; securable door means formed on the bag for allowing access to the interior in one orientation and preventing such access in another orientation; hanger means coupled to the bag and extendable upwards above the top edge for allowing the bag to be hung from a recipient object; hanger bar means coupled to the bag at a location facing the interior for holding dress-laden clothes hangers; and adjustable opposed hem clasp means coupled to the bag and facing the interior for gripping dresses therebetween extended downwards from dress-laden hangers held by the hanger bar means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment constructed in accordance with the principles of the present invention in a carrying configuration.

FIG. 2 is yet another perspective view of the present invention in a hanging configuration.

The same reference numerals refer to the same parts through the various Figures.

DESCRIPTION OF THE PREFERRED EMBODIMENT

Figure 3:
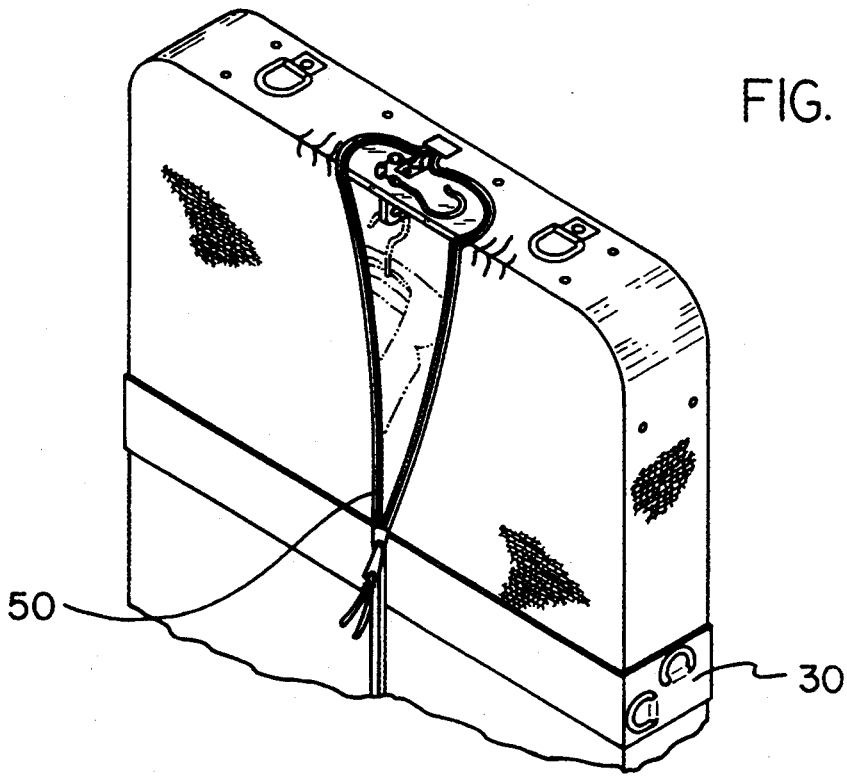
FIG. 3 is an enlarged perspective view of the top portion of the present invention depicting the relation of the zipper, upper reinforcing insert, and hanger.
Figure 4:
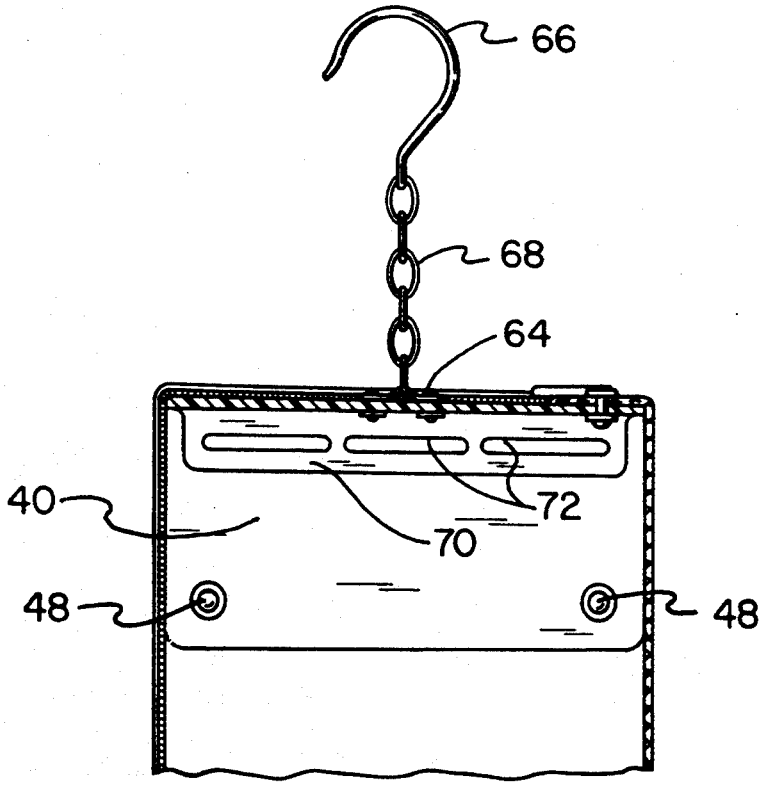
FIG. 4 is a cross-sectional view of the present invention depicting the coupling of the upper reinforcing insert with the hanger and hanger bar.
Figure 5:
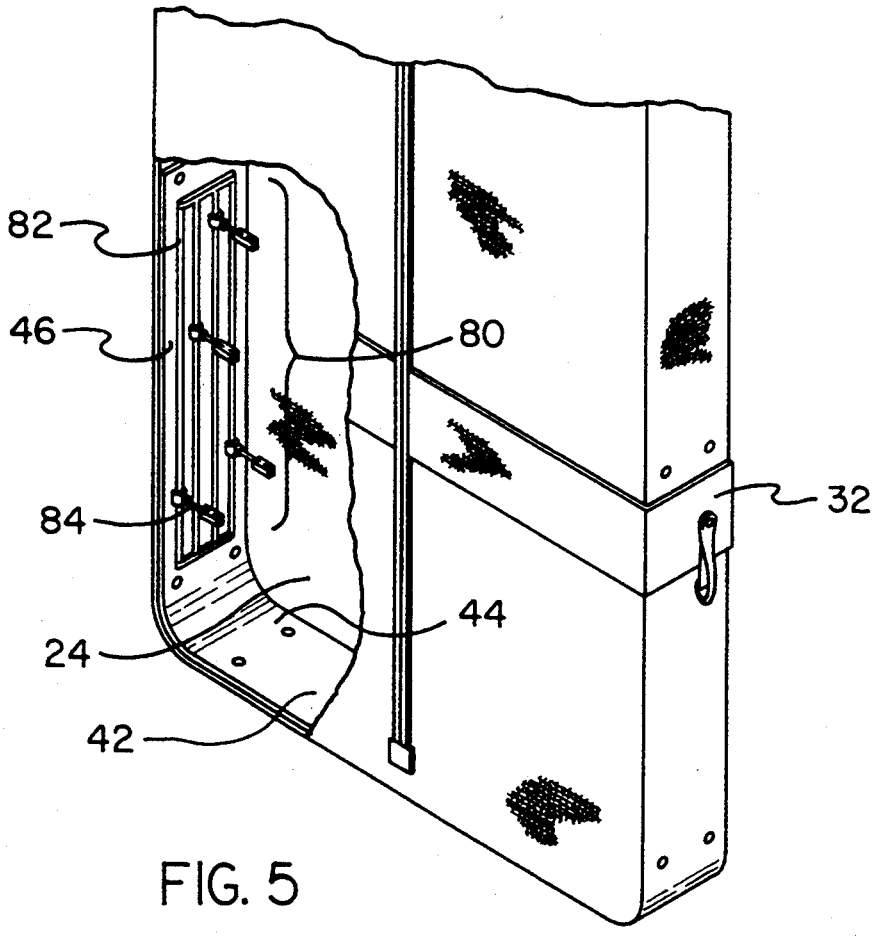
FIG. 5 is a perspective view of the present invention with a portion of the front wall removed for depicting a hem clasp mechanism.
Figure 6:
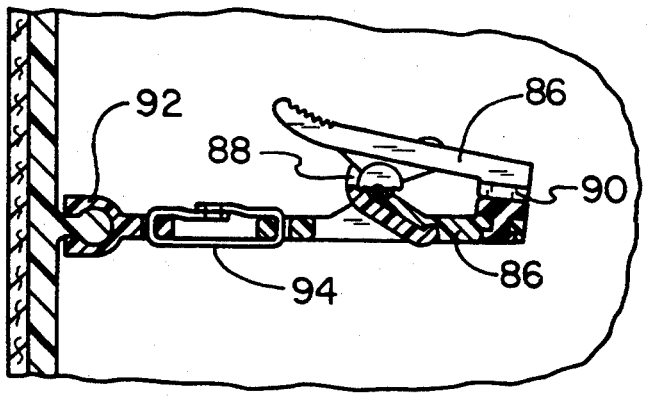
FIG. 6 is an enlarged cross-sectional view of a hem clasp and its coupling with a rib of the hem clasp mechanism.

With reference now to the drawings, the preferred embodiment of the new and improved garment bag for dresses embodying the principles and concepts of the present invention and generally designated by the reference number 10 will be described.

Specifically, the present invention essentially includes ten major components. The major components are the bag, reinforcing straps, reinforcing inserts, zipper, hanger, hanger bar, hem clasp mechanisms, edge fastener means, handle, and shoulder strap. These components are interrelated to provide the intended function of allowing a traveler to transport dresses of varying lengths on hangers from one location to another while simultaneously preventing the dresses from being wrinkled.

More specifically, it will be noted in the various Figures that the first major component is the bag 12. The bag is formed of a flexible fabric material such as nylon or plastic-coated cloth. The bag has a generally rectangular front wall 14 with rounded corners, a generally rectangular back wall 16 with rounded corners offset from the front wall, and a periphery formed therearound. The periphery includes a top edge 18, a bottom edge 20, and opposed side edges 22 interconnecting the front wall to the back wall. In this configuration, a hollow interior 24 is defined between the front, back wall, and periphery. This interior is used for transporting dresses and other garments therein from one location to another.

The second major component is the reinforcing straps. The present invention includes an upper reinforcing strap 30 and a lower reinforcing strap 32. Each reinforcing strap is formed of a non-stretchable fabric or plastic material. The upper reinforcing strap is secured about the front wall 14, the back wall 16, and the side edges 22 at a location offset below the top edge 18. The lower reinforcing strap is secured about the front wall, the rear wall, and the side edges at a location offset above the bottom edge 20. The reinforcing straps are utilized for ensuring that the bag maintains its relative shape when dresses and other garments are disposed within its interior. The reinforcing straps also help the dresses and garments maintain their relative positions within the bag so as not to become wrinkled.

The third major component is the reinforcing inserts. The present invention includes an upper reinforcing insert 40 and a lower reinforcing insert 42. Each reinforcing insert is formed of a rigid plastic or other similar rigid material. Each reinforcing insert has a U-shape formed with a cross leg 44 and two side legs 46 extended outwards from the cross leg. The upper reinforcing insert is coupled to the periphery of the bag at a location adjacent to the interior 24 such that its cross leg is extended along the top edge 18 and its side legs are extended downwards a portion along the side edges 22. The lower reinforcing insert is coupled to the periphery of the bag at a location adjacent to the interior such that its cross leg is extended along the bottom edge 20 and its side legs are extended upwards a portion along the side edges. The coupling of each of the reinforcing inserts to the periphery of the bag is performed with a plurality of rivets 48. The reinforcing inserts maintain the general shape of the bag and prevent its interior from being crushed, thereby ensuring that dresses and other garments disposed within therein do not change their relative position during transport and become wrinkled. Furthermore, the upper reinforcing insert also helps to protect the shape of collars on dresses and other garments.

The fourth major component is the zipper 50. The zipper is extended downwards from the center of the top edge 18 of the bag to a central location on the front wall 14 near the bottom edge 20. The zipper has an open orientation for allowing access to the interior for placing garments therein or removing garments therefrom. The zipper has a closed orientation for preventing such access to the interior.

The fifth major component is the hanger 60. The hanger is formed of rigid metal. The hanger allows the bag to be hung from a recipient object 62 such as a pole within a closet. The hanger has a base 64 coupled to the upper reinforcing insert 40 at a location aligned with the zipper 50. The hanger has a hook 66 couplable with the recipient object. Furthermore, the hanger includes a chain 68 extended between the base and hook. The chain essentially serves as an extended swivel for allowing the bag to be hung in an essentially vertical orientation in locations where the recipient securement object is angled or offset from the designated hanging space. The hanger is storable inside the bag and access thereto is prevented when the zipper is placed in the closed orientation.

The sixth major component is the hanger bar 70. The hanger bar is formed of metal or other similar rigid material. The hanger bar is coupled to the upper reinforcing insert 40 and extended towards the interior. The hanger bar has a plurality of slots 72 formed therethrough. These slots are adapted for receiving and holding dress-laden clothes hangers or other garment-laden clothes hangers therefrom.

The seventh major component is the hem clasp mechanisms. The present invention includes a pair of opposed hem clasp mechanisms. Each hem clasp mechanism 80 is coupled to a separate side leg 46 of the lower reinforcing insert 42 and positioned at a location adjacent to the interior 24. Each hem clasp mechanism is formed of four parallel ribs 82 extended along each side leg with a hem clasp 84 slidably and removably coupled to each rib. Opposed hem clasps of the opposed hem clasp mechanisms are adapted for gripping a dress therebetween that is extended downwards from a dress-laden hanger held by the hanger bar. Similarly, the hem clasp mechanisms can be used for gripping other garments. Each hem clasp is formed with a pair of opposed openable jaws 86. Each jaw has a tip end and a base end. The jaws are biased to a normally closed position through a plastic or metal spring 88. The tip end of each jaw has a rubber pad 90 formed thereon to protect the fabric of dresses or other garments. Each hem clasp is secured to a rib with a snap-type fastener 94. This snap-type fastener is couplable or decouplable from the rib and is slidable up and down the rib to match the length of dresses or other garments. Furthermore, an elastic band 94 couples the jaws to the snap-type fastener. The band dampens the shock applied to the garments during transport, thus preventing their stretching or tearing.

The eighth major component is the edge fastener means 100. The edge fastener means is coupled to the periphery of the bag remote from the interior. The edge fastener means is coupled in one orientation for placing the bag in a folded and generally U-shaped carrying configuration such that its bottom edge is positioned in proximity with its top edge and its zipper is concealed and generally inaccessible. The edge fastener means is decoupled in another orientation for allowing the bag to be placed in a hanging configuration such that its top edge is positioned above its bottom edge and its zipper is visible and accessible. In the preferred embodiment, the edge fastener means is formed of a plurality of hook and loop fasteners. Two hook and loop fasteners are used for proximally securing the top edge with the bottom edge in the carrying configuration. Furthermore, two hook and loop fasteners are also used for coupling the lower portion of each side edge in proximity with the corresponding upper portion of each side edge in the carrying configuration. The hook and loop fasteners on the side edges are positioned upon the upper and lower reinforcing straps for ensuring greater coupling strength.

The ninth major component is the handle 110. The handle is coupled to the bottom edge 20 of the bag. The handle allows the bag to be carried by a traveler by hand in the carrying configuration.

The tenth major component is the shoulder strap 120. The shoulder strap is adjustable in length through positioning of a buckle 122 coupled thereto. The shoulder strap has its free ends secured to the upper reinforcing strap on opposed side edges 22 of the bag for allowing the bag to be carried over a traveler's shoulder in the carrying configuration. In the preferred embodiment, the free ends are secured to each side edge with a pair of hook and loop fasteners. The loop of each fastener is coupled to the upper reinforcing strap for ensuring that the shoulder strap remains coupled to the bag when transporting from one location to another.

The present invention is a variation of prior art garment bags. The average prior art garment bag is about 45 inches to about 48 inches in length, which does not accommodate long dress styles. The present invention is longer than an average prior art garment bag for accommodating longer dresses. The bag of the present invention is formed of a cloth material and its reinforcing inserts are formed of plastic. The length of the bag as measured from the top edge to the bottom edge is approximately 58 inches. The width of the bag as measured from one side edge to the other side edge is approximately 22 inches. The depth of the interior of the bag is approximately 3 inches. The present invention includes opposed hem clasp mechanisms along the side edges thereof. These hem clasp mechanisms in combination with the dimensions of the present invention allow travelers to carry dresses of varying lengths without wrinkling. The opposed hem clasp mechanisms are adjustable from about the 40 inch mark as measured from the top edge of the bag to the 55 inch mark as measured from the top edge of the bag. Each hem clasp mechanism includes four hem clasps. The present invention's hem clasps mechanisms hold dresses in place. The present invention is narrower than the average garment bag such that the hem clasps thereof can clasp a garment without stretching it. The shoulder strap is adjustable but retains a shorter length to accommodate the longer length of the bag. The retaining straps in combination with the reinforcing inserts allow the bag to maintain its general shape such that when dresses are placed within the bag for transport, they maintain their relative position such as not to cause wrinkling.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A garment bag for dresses used for allowing a traveler to transport dresses of varying lengths on hangers from one location to another while preventing the dresses from being wrinkled comprising, in combination:

a bag formed of a flexible fabric material and having a generally rectangular front wall, a generally rectangular back wall offset from the front wall, and a periphery formed of a top edge, a bottom edge, and opposed side edges interconnecting the front wall to the back wall to thereby define a hollow interior;

an upper reinforcing strap and a lower reinforcing strap formed of a fabric material with the upper reinforcing strap secured about the front wall, back wall, and side edges at a location offset below the top edge and the lower reinforcing strap secured about the front wall, rear wall, and side edges at a location offset above the bottom edge;

an upper reinforcing insert and a lower reinforcing insert, each reinforcing insert formed of rigid plastic, each reinforcing insert having a U-shape formed with a cross leg and two side legs and with the upper reinforcing insert coupled to the periphery of the bag at a location adjacent to the interior such that its cross leg is extended along the top edge and its side legs are extended downwards along the side edges, the lower reinforcing insert coupled to the periphery of the bag at a location adjacent to the interior such that its cross leg is extended along the bottom edge and its side legs are extended upwards along the side edges;

a zipper extended downwards from the center of the top edge of the bag to a central location on the front wall near the bottom edge, the zipper having an opened orientation for allowing access to the interior and a closed orientation for preventing such access;

a rigid metal hanger for allowing the bag to be hung from a recipient object with the hanger having a base coupled to the upper reinforcing insert at a location aligned with the zipper, a hook, and a chain therebetween;

a rigid metal hanger bar coupled to the upper reinforcing insert and extended towards the interior, the hanger bar further having a plurality of slots formed therethrough adapted for holding dress-laden clothes hangers;

a pair of opposed hem clasp mechanisms, each hem clasp mechanism coupled to a side leg of the lower reinforcing insert at a location adjacent to the interior, each hem clasp mechanism formed of four parallel ribs extended along each side leg with a hem clasp slidably and removably coupled to each rib and with opposed hem clasps of the opposed hem clasp mechanisms adapted for gripping a dress therebetween extended downwards from a dress-laden hanger held by the hanger bar;

edge fastener means coupled to the periphery of the bag remote from the interior with the edge fastener means coupled in one orientation for placing the bag in a folded and generally U-shaped carrying configuration such that its bottom edge is positioned in proximity with its top edge and its zipper is concealed and with fastener means decoupled in another orientation for allowing the bag to be placed in a hanging configuration such that its top edge is positioned above its bottom edge and its zipper is visible;

a handle coupled to the bottom edge of the bag for allowing the bag to be carried by a traveler by hand in the carrying configuration; and an adjustable shoulder strap having its free ends secured to the upper reinforcing strap on opposed side edges of the bag for allowing the bag to be carried over a traveler's shoulder in the carrying configuration.

2. A garment bag for dresses comprising:

a bag having a front wall, a back wall offset from the front wall, and a periphery further formed of a top edge, a bottom edge, and opposed side edges interconnecting the front wall to the back wall to thereby define a hollow interior;

securable door means formed on the bag for allowing access to the interior in one orientation and preventing such access in another orientation;

hanger means coupled to the bag and extendable upwards above the top edge for allowing the bag to be hung from a recipient object;

hanger bar means coupled to the bag at a location facing the interior for holding dress-laden clothes hangers; and adjustable opposed hem clasp means coupled to the bag and facing the interior thereof for gripping dresses therebetween extended downwards from dress-laden hangers held by the hanger bar means.

3. The garment bag for dresses as set form in claim 2 further including a plurality of spaced reinforcing straps secured about the front wall, back wall, and side edges of the bag for allowing the bag to retain its general shape.

4. The garment bag for dresses as set form in claim 2 further including reinforcing insert means coupled to the periphery of the bag and facing the interior thereof for allowing the bag to retain its general shape.

5. The garment bag for dresses as set form in claim 2 further including edge fastener means coupled edges of the bag with the edge fastener means coupled in one orientation for placing the bag in a folded carrying configuration and with fastener means decoupled in another orientation for allowing access to the interior thereof.

6. The garment bag for dresses as set form in claim 2 further including a handle coupled the bag for allowing the bag to be carried by a traveler.

7. The garment bag for dresses as set form in claim 2 further including an adjustable shoulder strap having its free ends secured to the bag for allowing the bag to be carried over a traveler's shoulder.

8. The garment bag for dresses as set form in claim 2 wherein the bag has a length of about 58 inches $+-10\%$ as measured from the top edge to the bottom edge thereof, a width of about 22 inches $+-10\%$ as measured from one side edge to the other side edge thereof, and a depth of about 3 inches $+-10\%$ as measured from the top wall to the bottom wall thereof.

* * * * *